US005879778A

United States Patent [19]

Barnes

[11] Patent Number: 5,879,778

[45] Date of Patent: Mar. 9, 1999

[54] STRENGTHENING OF STRUCTURAL MEMBERS

[75] Inventor: Frazer John Charles Barnes, Cornwell, Great Britain

[73] Assignee: Davonport Management Limited, Great Britain

[21] Appl. No.: 875,119

[22] PCT Filed: Jan. 22, 1996

[86] PCT No.: PCT/GB96/00121

§ 371 Date: Jul. 21, 1997

§ 102(e) Date: Jul. 21, 1997

[87] PCT Pub. No.: WO96/22432

PCT Pub. Date: Jul. 25, 1996

[30] Foreign Application Priority Data

Jan. 21, 1995 [GB] United Kingdom ..... 9501193

[51] Int. Cl.[6] ..... B32B 1/06

[52] U.S. Cl. ..... 428/102; 52/309.1; 52/309.3; 427/140; 427/142; 427/206; 427/294; 427/295; 427/296; 427/369; 427/370; 427/393.6; 428/703; 442/239

[58] Field of Search ..... 428/102, 703; 427/140, 142, 206, 369, 370, 294, 295, 296, 393.6; 52/309.1, 309.3; 442/239

[56] References Cited

U.S. PATENT DOCUMENTS

| | | | |
|---|---|---|---|
| 5,043,033 | 8/1991 | Fyfe | 156/71 |
| 5,218,810 | 6/1993 | Isley | 52/725 |

FOREIGN PATENT DOCUMENTS

| | | |
|---|---|---|
| 0378232 | 7/1990 | European Pat. Off. . |
| 2205084 | 5/1974 | France . |
| 2594871 | 8/1987 | France . |
| 2850329 | 5/1979 | Germany . |
| 2909179 | 9/1980 | Germany . |
| 1490102 | 10/1977 | United Kingdom . |

*Primary Examiner*—James J. Bell

*Attorney, Agent, or Firm*—Harold L. Novick; Nath & Associates

[57] ABSTRACT

A method and a pre-form for strengthening a substrate structural member. Layers are applied to a surface of a substrate where the layers include dry fibre reinforcement materials. A reduced pressure is then applied to the layers and a curable resin is introduced to the layers such that the resin is drawn therethrough until the interstices therein are substantially filled with the resin. The resin is then cured. The layers are preferably woven fabric and may include resin distribution layers of relatively low weave density and high permeability and reinforcement layers of higher weave density and lower permeability. The layers may be provided as a pre-form.

18 Claims, 3 Drawing Sheets

STRENGTHENING OF STRUCTURAL MEMBERS

FIELD OF THE INVENTION

This invention relates to the strenghthening of structures particularly, but not exclusively, proposes an improved reinforcement for existing structures or structural members. Suitable structures may comprise any engineering material including, for example, structural and stainless steels, aluminium, cast iron, concrete, timber, and fibre reinforced plastics, and may be in any form, for example plate-form, tubular or of other hollow cross-section, or in the form of other common engineering sections.

BACKGROUND OF THE INVENTION

In many cases, existing structures require reinforcement for strengthening purposes because the standards to which they were designed are no longer considered to be adequate, use of the structure has exceeded that for which it was originally designed, the structure is damaged due to fatigue, corrosion or impact or simply because the structure has reached the end of its expected life.

Conventionally, such structures are strengthened by the addition of new material of the same type as the existing structure, for example reinforcement of steel or aluminium structures by welding or mechanical fastening techniques, reinforcement of cast iron, timber or fibre-reinforced plastics structures by mechanical fastening techniques, and reinforcement of fibre-reinforced plastics structures by bonding. Where new material of a different type is to be added to a structure, a combination of bonding and mechanical fastening may be used, for example in the attachment of steel plates to a concrete structure. However, these methods have problems associated with either the practicality of their implementation at the worksite or with the structural efficiency of the materials used. Additionally, methods involving welding or mechanical fastening can often result in zones of increased stress which may cause weakening or failure of previously sound areas of the original structure.

Advanced fibre reinforced polymer composites have properties which make them very well suited to the reinforcement of existing structures. Typical fibres include the whole range of carbon fibres, some aramid fibres and some of the high performance glass fibres. The advantages of these materials compared with the common engineering materials from which most structures are manufactured are high specific properties, leading to low weight and compactness, creating a low burden on existing structures and providing easy handling. Additionally, the ability to use adhesive bonding to attach the reinforcing materials reduces stress concentrations in the original structure and the freedom from maintenance of the reinforcing materials reduces through life costs. Advanced fibre reinforced polymer composites are therefore considered to be improved reinforcement materials.

Advanced fibre reinforced polymer composites are usually manufactured in highly controlled workshop environments sometimes called "clean rooms". Most manufacturing techniques for advanced fibre reinforced polymer composites are based on working in such environments.

EP-A-0378232 describes one use of advanced fibre reinforced polymer composites to reinforce existing concrete structures. Because the method described results in a composite material having a low fibre volume fraction (and hence comparatively low stiffness and strength) and a low strength bondline, the method is limited in its application to concrete. The materials used in this process are a combination of a pre-preg, and a general purpose room temperature-setting epoxy adhesive.

SUMMARY OF THE INVENTION

According to one aspect of the present invention, a method for strengthening of a substrate structural member comprises the steps of applying, to a surface of the substrate, layers comprising reinforcement materials in the form of dry fibres having a high aspect ratio and directionally arranged according to the structural loading requirement of the substrate structural member, applying a reduced pressure to the material layers, introducing a curable resin to the layers such that the resin is drawn therethrough until the interstices therein are substantially filled with resin, and curing the resin.

The substrate may optionally have a primer or sealer layer initially applied thereto.

The reinforcement materials preferably include materials having different fibre constructon density and permeability, in order to influence the resin distribution properties of the system. The layers may have fibres arranged in two or more directions in order to influence the strength and stiffness properties. Generally, the layers include a layer of a first material having a relatively low fibre construction density and high permeability as a resin distribution layer adjacent the substrate, with one or more further such layers elsewhere in the laminated system and intermediate layers of a second material having a higher fibre construction density as structural reinforcement layers. The fibres of the structural reinforcement layers generally have a high aspect ratio (length:width) and are arranged in directions to suit the structural loading requirements. The resin distribution layers generally have a more open disposition of fibres such that resin pathways therein permit resin flow in directions which are both substantially parallel to the principal axes of the longitudinally-disposed fibres of the reinforcement layers and substantially perpendicular to said principal axes. The construction of some of the layers of fabric may be designed to provide different levels of permeability in different directions to control resin flow. In particular, some layers with very low permeability may be included at the interface to the existing structure to promote good bonding to the existing structure, and more such layers at various intervals throughout reinforcements with many layers in order to promote even resin flow throughout. The high permeability layers may be either structural or non structural.

The final layer may be a removable sealing material designed on removal to allow further applications of reinforcement material or painting without the need for surface preparation.

Preferably, the dry fibre reinforcement layers comprise from two to sixty layers of fibre-containing material. The fibre volume density may be as high as 50–60% of the cured laminated system. The bond strength of the resin is typically between 15–30 MPa in tensile shear and between 15–35 MPa in pure tension. The material of the resin distribution layers may per se contribute structural strength to the resulting reinforcement or may have no, or only limited, intrinsic structural strength in relation to the strength of the structural materials.

The material of the structural reinforcement layers, which is preferably a woven fabric material, may be selected from one or more of carbon fibres, glass or other vitreous fibre, thermoplastic fibre, aramid fibre, polyethylene and polyester fibres and ceramic fibre. The material of the resin distribution layers may also be formed from such materials if they are intended to provide structural strength. The fibres in both types of material are arranged, preferably substantially within the plane of the layer, in different directions, preferably between 2 and 4 directions, according to the applied load conditions and the fibres in the resin distribution layers are arranged to control flow of the resin. For example a biaxial weave pattern in the material would provide resin pathways in predominantly mutually orthogonal directions. If the resin distribution layers do not per se contribute structural strength, they may comprise non-woven fibrous material such as cotton. Where woven fabric materials are used, the fibre construction density is the weave density.

Advantageously, the method of the invention can be carried out in situ thus avoiding the need for so-called clean room environments. The fibre reinforcements may, however, be assembled as a pre-form, which constitutes a further aspect of the invention, containing a plurality of layers of resin permeable dry fibres having a high aspect ratio, the layers being loosely stitched together and including resin distribution layers having a relatively low fibre construction density and high permeability and strengthening layers having a relatively high fibre construction density and low permeability. The loose stitches allow the pre-form to be shaped to complex curvatures and provide through-thickness strength to the resulting reinforcement.

Preferably, the pre-form is made in a workshop and then despatched to the work site where the existing structure to which the reinforcement is to be applied is prepared by removing all loose material and surface coatings. Optionally, a primer may be applied to the structure to seal the surface, enhance bonding to the surface or provide electrical insulation between a carbon fibre reinforcing material and the existing structure.

In order to draw the resin through the reinforcement layers under the influence of reduced pressure, the reduced pressure is generally applied at one end of the layers, in relation to the principal axes of the fibres, and the resin is introduced at the other end, whereby resin flows preferentially through the resin distribution layers, both in substantially longitudinal and substantially perpendicular (vertical) directions relative to the said principal axes, and thence to the reinforcement layers, until the fibres are wetted out, and the interstices are substantially filled or impregnated with resin. The layers are initially covered in use with a flexible, fluid-impermeable sheet member in releasable fluid-tight engagement with the substrate surface, surrounding the layers. A suction duct or manifold in communication with a vacuum pump is disposed under the sheet member at or adjacent one end of the layers,and a resin supply means disposed at or adjacent the other end. Thus, on application of reduced pressure, the sheet member will be drawn by suction into intimate and sealing engagement with at least the upper layer, thus consolidating the reinforcing fabric layers and forcing them into close contact with the substrate surface, and resin will be drawn initially through the resin distribution layers and thence to and through the structural reinforcement layer or layers. Resin continues to be drawn through the layers until the fibre materials are substantially fully wetted out and the interstices are substantially filled with resin; the resin is either allowed to cure as it continues to be drawn through, until the establishment of a gel structure prevents further flow, or is cured after the supply of resin is isolated, still under reduced pressure. The method of curing and the nature of the curing reaction depends on the type of resin, which itself is not critical to the performance of the invention provided that in the liquid state it is sufficiently low in viscosity to penetrate the layers and that in the cured state it has the requisite mechanical properties, resistance to corrosion or aggressive environments generally, and so on. Thus, the resin may be selected from thermosetting polyesters, epoxy resins, phenolics and vinyl esters among others, and the curing reaction may be addition or condensation polymerisation initiated by a catalyst, free radicals, heat or moisture. Processing at low temperatures may be improved by the addition of air release and wetting agents to the resin before use and by degassing the resin before use.

If the reinforcement is carried out underwater, the reduced pressure may assist in drying the wet fabric layers before introduction of resin.

Preferably, in the reinforcement layers, the interstices of the final or uppermost resin distribution layer are blocked at the downstream end region, adjacent the suction duct or manifold, to prevent a direct low-resistance flowpath from occurring between the resin supply means and the suction duct. Where relatively thick laminate layers are required, it is desirable for the final or uppermost layer or layers to be constituted by a relatively highly porous material which may extend around the edges of the lower laminated layers to provide a resin supply distribution and equilibration zone between the resin supply means and the reinforcement layers, to ensure that even those layers the upstream ends of which are not in the direct resin flowpath receive an adequate supply of resin.

Optionally, a further layer comprising a removable peel or tear ply may be provided over the uppermost resin distribution layer, where there is a requirement for subsequent bonding to or painting of the finished reinforcement. Additionally or alternatively, a layer of an electrically-conductive fabric may be provided over the uppermost resin distribution layer or the ply, to provide for heating of the layers for the purpose of accelerated curing or in situ postcure; such a heating layer can either be removable or incorporated as a permanent element, should there be a requirement for elevated temperatures during the service life of the reinforced material. An overall caul sheet or plate may be provided immediately below the flexible fluid-impermeable sheet member, to consolidate the laminated system, to promote even distribution of the reduced pressure and, where appropriate, to hold the layers in place on a vertical or overhead surface during cure. Such a caul sheet may be formed from a rigid plastics material or a flexible, resilient material such as rubber, and should be of a thickness sufficient to prevent flow of resin from the resin supply means between the reinforcement layers and the fluid-impermeable sheet member, direct to the suction duct. Optionally, the caul sheet may be profiled to provide channels for resin flow as an alternative to the uppermost, partially blocked resin distribution layer.

When the resin is fully cured, the resin and fibre materials form a composite reinforcement, the resin acting as a bonding and consolidation agent between the fibre material layers and the substrate. The flexible sheet member, peel or tear ply, caul sheet, optionally the conductive fabric, the resin supply means and the suction duct, together with sealants or any other ancillary items of equipment, may all be removed from the thus-produced composite reinforcement.

BRIEF DESCRIPTION OF THE DRAWINGS

Embodiments of the invention will now be described by way of example with reference to the accompanying drawings, of which.

DETAILED DESCRIPTION OF THE PREFERRED EMBODIMENTS

Figure 1:
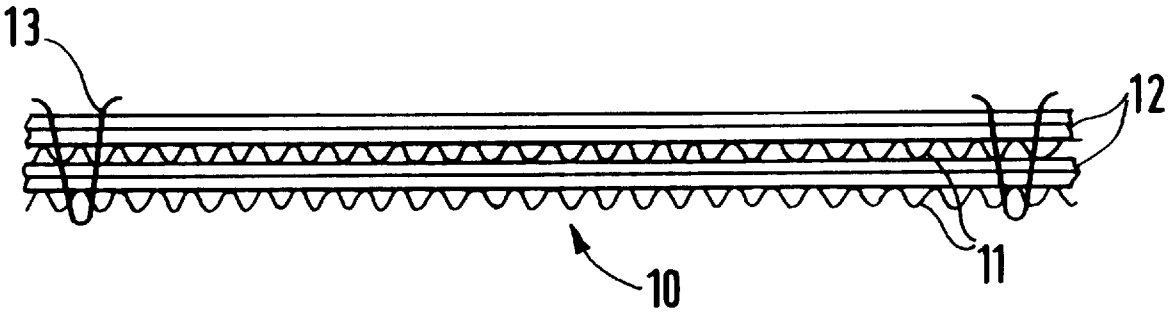
FIG. 1 is a cross sectional view of reinforcement layers prepared as a pre-form.

With reference to FIG. 1, the pre-form shown generally at 10 consists of layers of high-permeability fabric material 11 and layers of higher-density fabric material 12. The layers 11 act as resin distribution layers and the layers 12 act as structural reinforcement layers. The outer (lower-facing) layer 11 is intended to lie adjacent the substrate to be repaired or strengthened in use. The layers are loosely held together by stitching 13. The resin distribution layers 11 improve resin supply to the substrate and throughout the pre-form, whereas the structural reinforcement layers provide strength to the repair.

Resin distribution layers 11 are formed from a biaxally woven polyester fibre; the initial or lower layer has a lower weave density than the central layer. The structural fibrous reinforcement layers 12 are formed from carbon fibres having mainly longitudinal fibres such that the flowpaths therein are predominantly longitudinally-oriented, whereas the layers 11 have predominantly transverse fibres such that the flowpaths are oriented to provide resin pathways having components directed perpendicularly to the plane of the layers and to the longitudinal direction.

Figure 2:
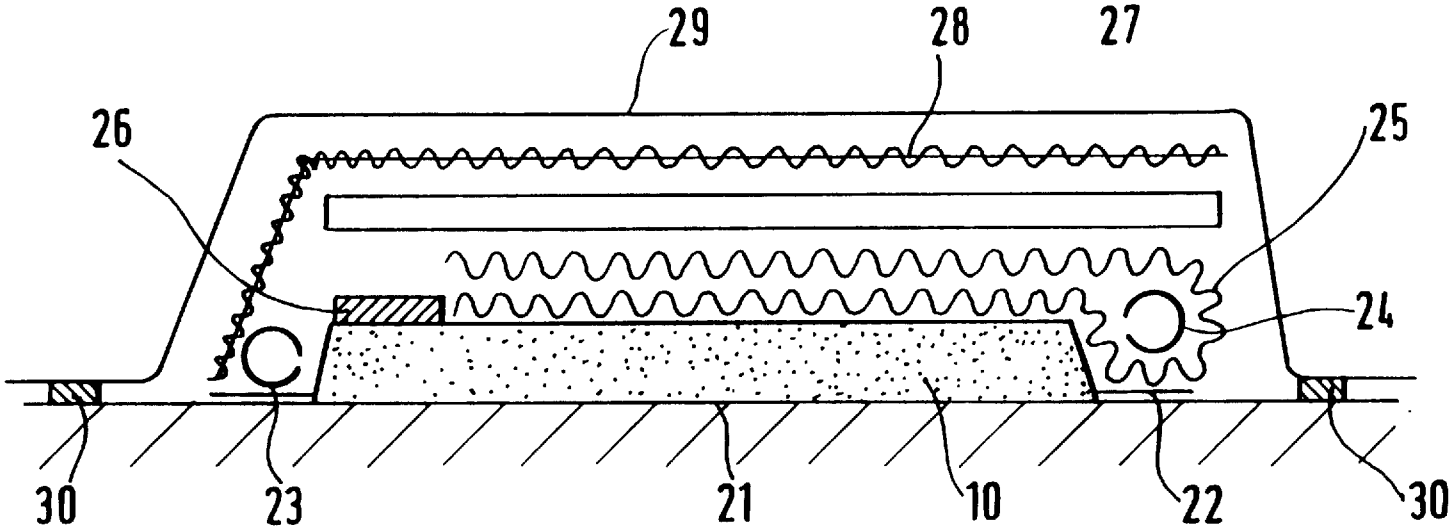
FIG. 2 shows the arrangement of materials including the pre-form of FIG. 1 for repair of a sheet substrate.

Referring to FIG. 2, the pre-form 10 is shown in position on one face of a plate substrate 21, optionally covered by a removable tear ply sheet 22. A suction channel 23 is disposed at one end of the pre-form and a resin supply pipe 24 is disposed at the other end, surrounded by a highly permeable resin distribution film layer 25 which extends across the top of the pre-form towards the suction channel 23. A resin block 26 is provided at the end adjacent the suction channel 23. A caul plate 27 is optionally disposed over the resin distribution layer 25 and is optionally overlaid with a conductive fabric layer 28. An impervious sheet 29 is placed over the entire assembly and is peripherally sealed to the substrate by use of double-sided adhesive tape or a mastic sealing compound 30. Connections to the conductive fabric and connections to a vacuum pump and resin reservoir (not shown) for the suction channel and resin supply pipe respectively are provided through the sheet 29 with suitable sealing.

In use, a suction is applied through the channel 23 and, when the desired reduced pressure has been achieved, resin is allowed to flow into the resin supply pipe 24. Resin is drawn therefrom and flows firstly through the resin distribution layers 25 and then into the pre-form layers, wetting out the fibres. When the desired quantity of resin has flowed into the system, the resin supply is stopped; alternatively, resin is allowed to continue to flow until gelling takes place. The conductive fabric may now be energised to generate heat for accelerating the curing stage or post-curing of the laminate. The pipes, caul sheet, impervious cover sheet, sealant tape and conductive fabric (unless required for service) may now be removed. The peelable tear ply layer may also be removed, either at this stage or before application of further reinforcement/resin distribution layers or painting.

For general reinforcement purposes on structural steelwork, typical dimensions of the resulting composite reinforcement are 8 m length, 500 mm width and 35 mm thickness. The reinforcement has excellent substrate adhesion and an excellent strength:weight ratio.

Figure 3:
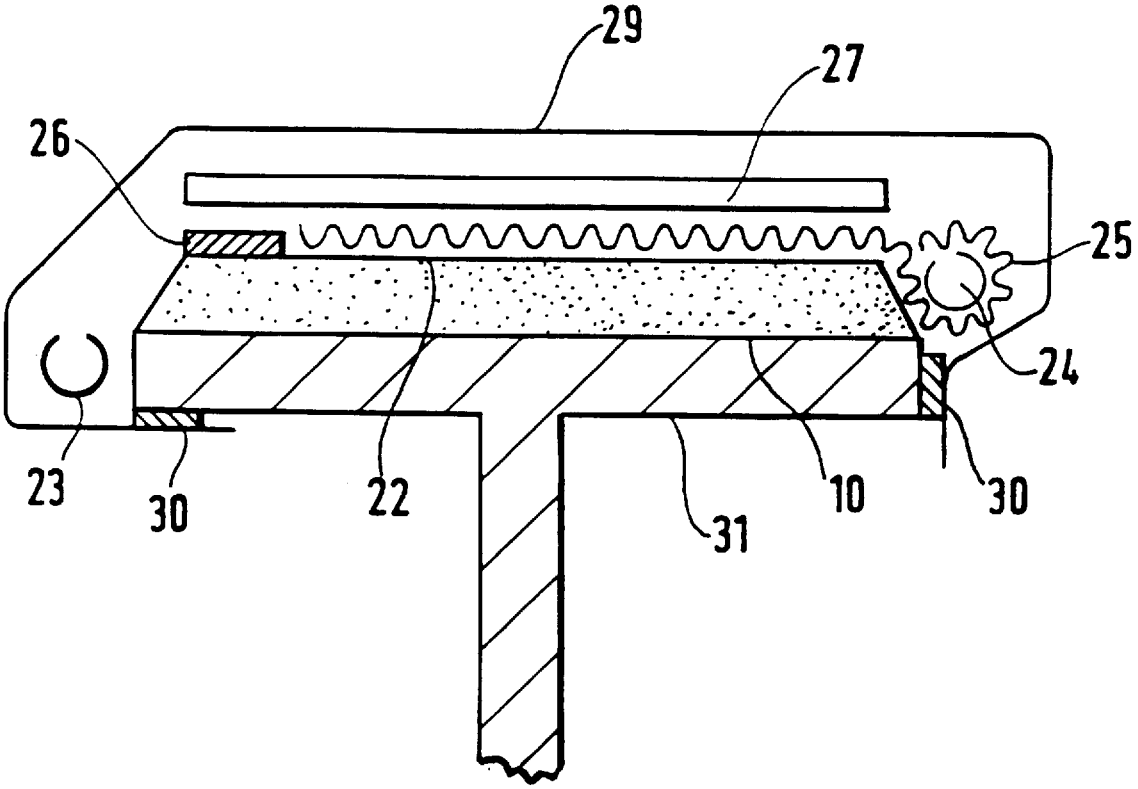
FIG. 3 shows an arrangement similar to FIG. 2 for repair of the flange of a structural girder.
Figure 4:
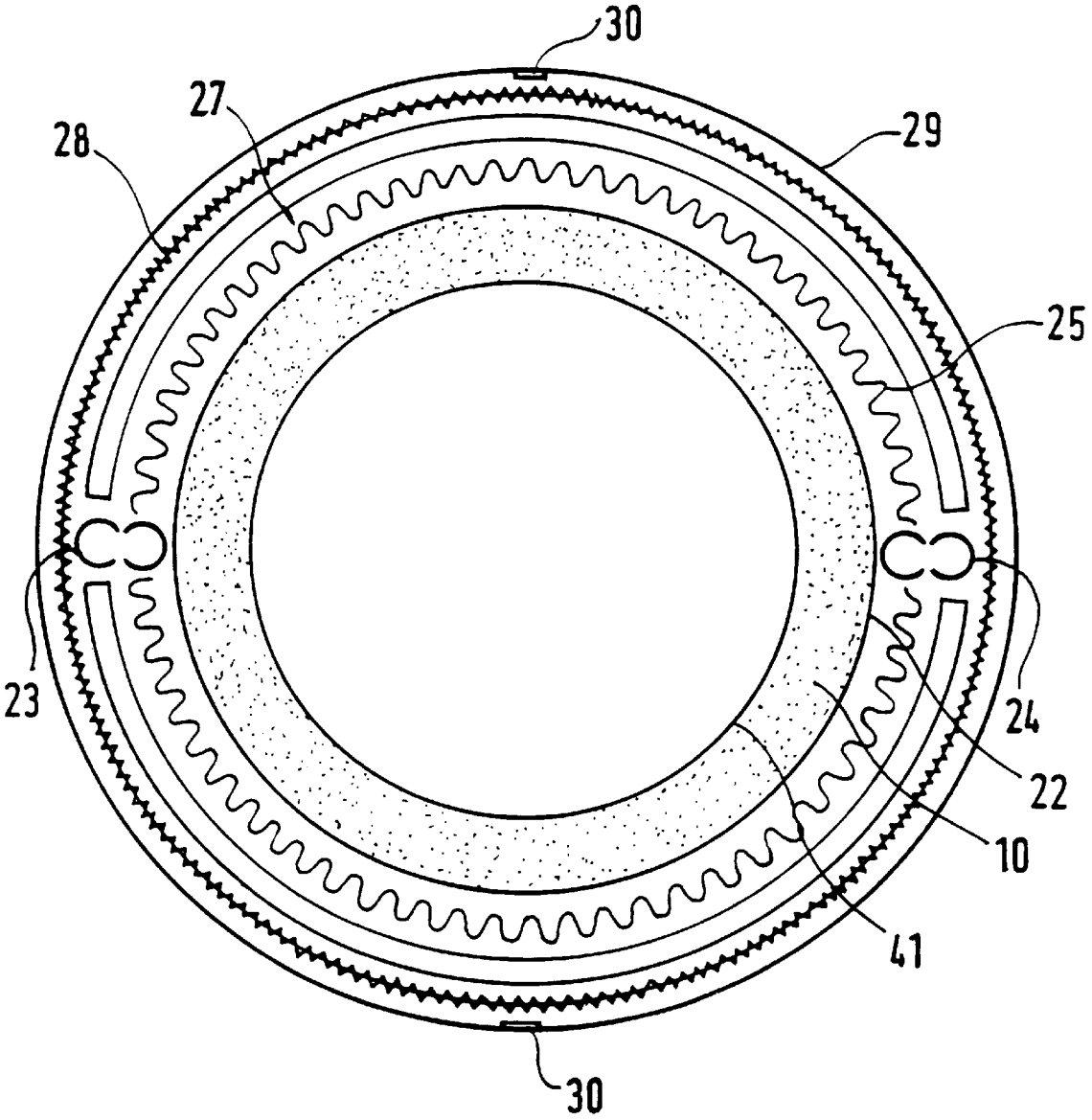
FIG. 4 shows an arrangement similar to FIG. 2 for repair of a tubular section.

FIG. 3 and 4 show arrangements similar to that of FIG. 2 as applied to the flange of a girder 31 (FIG. 3) and a tube 41 (FIG. 4). Typical dimensions for the strengthening of steel beams on an offshore oil production platform are 7 m long by 0.2 m wide reinforcing patches, each up to 54 layers thick; and for the repair of girth welds in pipelines using circumferential wraps of the reinforcing material, a patch 0.6 m long by the circumference of the pipe, each wrap being up to 10 layers thick, may be used.

I claim:

1. A method for the strengthening of a substrate structural member comprising the steps of applying, to a surface of the substrate, layers comprising reinforcement material in the form of dry fibres having a high aspect ratio and directionally arranged according to the structural loading requirements of the substrate structural member, applying a reduced pressure to the material layers, introducing a curable resin to the layers such that the resin is drawn therethrough until the interstices therein are substantially filled with resin, and curing the resin.

2. A method according to claim 1, in which the substrate has a layer of primer or sealer initially applied thereto.

3. A method according to claim 1, in which the layers comprise materials having different fibre construction density and permeability including a layer of a first material having a relatively low fibre construction density and high permeability adjacent the substrate as a resin distribution layer and one or more further layers having a higher fibre construction density as structural reinforcement layers.

4. A method according to claim 1, in which the fibres in the reinforcement materials are arranged in different directons.

5. A method according to claim 3, in which the structural reinforcement layers include a further resin distribution layer in an intermediate position.

6. A method according to claims 5, in which the resin distribution layers have a more open distribution of fibres than the structural reinforcement layers, such that resin flows in directions which are both substantially parallel to the principal axes of the longitudinally-disposed fibres and substantually perpendicular thereto.

7. A method according to claim 1, in which the resin has a bond strength of between 15 and 30 MPa in tensile shear and of between 15 and 35 MPa in pure tension.

8. A method according to any preceding claim 1, in which the fibre is selected from one or more of carbon fibre, glass or other vitreous fibre, thermoplastic fibre, aramid fibre, polyethylene and polyester fibres and ceramic fibre.

9. A method according to claims 3, in which the material of the resin distribution layers is non-woven and comprises cotton.

10. A method according to claim 1, in which the resin is a polyester resin, an epoxy resin, a phenolic resin or a vinyl ester resin.

11. A method according to claim 1, in which the resin is cured catalytically, by free-radical initiation, by application of heat or by moisture.

12. A method according to claim 1, in which the reduced pressure is applied at one end of the layers, in relation to the direction of orientation of the principal axes of the fibres in the fibre-containing material, and the resin is introduced at the other end.

13. A method according to claim 12, in which the resin is introduced via a resin distribution layer which is blocked at the downstream end region.

14. A method according to claim 1, including the use of a removable peel or tear ply, a layer of an electrically-conductive fabric, and/or an overall caul sheet or plate over the reinforcement layers.

15. A pre-form for use in the strengthening of a substrate structural member the pre-form comprising a plurality of layers of resin-permeable dry fibres having a high aspect ratio, the lavers being loosely stitched together and including resin distribution layers having a relatively low fibre construction density and high permeability and strengthening layers having a relatively high fibre construction density and low permeability.

16. A pre-form according to claim 15, in which the fibres in the reinforcement layers are aligned in from 2 to 4 different directions.

17. A pre-form according to claim 15, in which one or more resin distribution layers are provided for disposition in use against the substrate, and at one or more intermediate locations through the layers of the pre-form.

18. A pre-form according to any of claims 15, including a removable sealing material as a final layer.

* * * * *